US011749154B2

(12) United States Patent
Tao

(10) Patent No.: US 11,749,154 B2
(45) Date of Patent: Sep. 5, 2023

(54) GATE DRIVER ON ARRAY CIRCUIT AND DISPLAY PANEL

(71) Applicant: WUHAN CHINA STAR OPTOELECTRONICS TECHNOLOGY CO., LTD., Hubei (CN)

(72) Inventor: Jian Tao, Hubei (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 469 days.

(21) Appl. No.: 17/051,402

(22) PCT Filed: Aug. 28, 2020

(86) PCT No.: PCT/CN2020/112065
§ 371 (c)(1),
(2) Date: Oct. 28, 2020

(87) PCT Pub. No.: WO2022/007147
PCT Pub. Date: Jan. 13, 2022

(65) Prior Publication Data

US 2023/0177991 A1 Jun. 8, 2023

(30) Foreign Application Priority Data

Jul. 10, 2020 (CN) ..... 202010664959.0

(51) Int. Cl.
*G09G 3/20* (2006.01)

(52) U.S. Cl.
CPC ..... *G09G 3/20* (2013.01); *G09G 2300/0408* (2013.01); *G09G 2310/0267* (2013.01); *G09G 2310/0283* (2013.01); *G09G 2310/08* (2013.01)

(58) Field of Classification Search
CPC ..... G09G 3/20; G09G 2300/0408; G09G 2310/0267; G09G 2310/0283; G09G 2310/08
See application file for complete search history.

(56) References Cited

U.S. PATENT DOCUMENTS

2018/0323180 A1* 11/2018 Cok ..... H01L 23/5386
2018/0330663 A1* 11/2018 Yang ..... G09G 3/3266

FOREIGN PATENT DOCUMENTS

| | | | |
|---|---|---|---|
| CN | 107799083 | A | 3/2018 |
| CN | 108470535 | A | 8/2018 |
| CN | 108630167 | A | 10/2018 |
| CN | 111028798 | A | 4/2020 |
| KR | 20190045661 | A | 5/2019 |

* cited by examiner

*Primary Examiner* — Sejoon Ahn

(57) ABSTRACT

A gate driver on array (GOA) circuit and a display panel are provided. The GOA circuit includes multi-stage cascaded GOA units, and each GOA unit includes a bootstrap module. The bootstrap effect of the bootstrap module is utilized to increase the gate voltage of the output transistor, which can effectively reduce the rise time and fall time of the scan signal output by each GOA unit, thereby improving the charging capability of the display panel.

20 Claims, 3 Drawing Sheets

GATE DRIVER ON ARRAY CIRCUIT AND DISPLAY PANEL

FIELD OF INVENTION

The application relates to the field of display technology, in particular to a gate driver on array (GOA) circuit and a display panel.

BACKGROUND OF INVENTION

Gate driver on array (GOA) technology integrates a gate drive circuit on an array substrate of a display panel to achieve progressive scan driving. This can eliminate the gate driver circuit part, which has advantages of reducing production costs and realizing a narrow border design of the panel, and it is used by various displays.

Technical Problem

For a display panel with high resolution and high display frequency, due to its short charging time, the capacitive load of scan line is heavier, resulting in a serious distortion of the scan signal, high risk of incorrect charging, and insufficient charging capacity, which may further cause abnormal display of the display panel.

SUMMARY OF INVENTION

The present application provides a gate driver on array (GOA) circuit and a display panel to solve the technical problem that current display panels with high resolution and high display frequency have insufficient charging capacity during operation.

The present application provides a gate driver on array (GOA) circuit, including GOA units with multi-stage cascade, each stage of the GOA unit includes a pull-up control module, a bootstrap module, a pull-up module, a pull-down module, a pull-down maintenance module, and a reset module; wherein the pull-up control module is input with a N−2th stage scan signal and a forward scan signal, is electrically connected to a first node, and is configured to output the N−2th stage scan signal to the first node under control of the forward scan signal; the bootstrap module is input with a N−1th stage clock signal, is electrically connected to the first node and the second node, and is configured to pull up a potential of the second node under control of a potential of the first node and the N−1th stage clock signal; the pull-up module is input with a Nth stage clock signal, is electrically connected to the second node and the output terminal of a Nth stage scan signal, and is configured to output the Nth stage scan signal under control of the Nth stage clock signal and the potential of the second node; the pull-down module is input with the forward scan signal, a reverse scan signal, a N+2th stage clock signal, a N−2th stage clock signal, a N+2 stage scan signal, a high-level signal, and a low-level signal, is electrically connected to the first node and a third node, and is configured to pull down the potential of the first node under control of the forward scan signal, the reverse scan signal, the N+2th stage clock signal, the N−2 stage clock signal, the N+2 stage scan signal, the high-level signal, and the low-level signal; the pull-down maintenance module is input with the low-level signal, is electrically connected to the second node, the third node, and the output terminal of the Nth stage scan signal, and is configured to maintain low potentials of the second node and the Nth stage scan signal under control of a potential of the third node and the low-level signal; and the reset module is input with a reset signal, is electrically connected to the third node, and is configured to reset the potential of the second node and potential of the Nth stage scan signal under control of the reset signal.

In the GOA circuit provided by the present application, the pull-up module includes a first transistor; a gate of the first transistor is input with the N−2th stage scan signal, a source of the first transistor is input with the forward scan signal, and a drain of the first transistor is electrically connected to the first node.

In the GOA circuit provided in the present application, the bootstrap module includes a seventh transistor and a first capacitor. A gate of the seventh transistor, a source of the seventh transistor, and a first terminal of the first capacitor are all electrically connected to the first node, a drain of the seventh transistor is electrically connected to the second node, and a second terminal of the first capacitor is input with the N−1th stage clock signal.

In the GOA circuit provided by the present application, the pull-up module includes a third transistor, a gate of the third transistor is electrically connected to the second node, a source of the third transistor is input with the Nth stage clock signal, and a drain of the third transistor is electrically connected to the output terminal of the Nth stage scan signal.

In the GOA circuit provided by the present application, the pull-down module includes a second transistor, a fifth transistor, a sixth transistor, an eighth transistor, and a ninth transistor. A gate of the fifth transistor is input with the forward scan signal, and a source of the fifth transistor is input with the N+2th stage clock signal, a drain of the fifth transistor is electrically connected to a drain of the sixth transistor and a gate of the eighth transistor, a source of the sixth transistor is input with the N−2th stage clock signal, a gate of the sixth transistor and a source of the second transistor are both input with the reverse scan signal, a gate of the second transistor is input with the N+2 stage scan signal, a drain of the second transistor and a gate of the ninth transistor are both electrically connected to the first node, a source of the ninth transistor is input with the low-level signal, a drain of the ninth transistor and a drain of the eighth transistor are both electrically connected to the third node, and a source of the eighth transistor is input with the high-level signal.

In the GOA circuit provided by the present application, the pull-down maintenance module includes a second capacitor, a fourth transistor, and a tenth transistor; a first terminal of the second capacitor, a gate of the fourth transistor, and a gate of the tenth transistor are all electrically connected to the third node, a second terminal of the second capacitor, a source of the fourth transistor, and a source of the tenth transistor are all input with the low-level signal, a drain of the fourth transistor is electrically connected to the output terminal of the Nth stage scan signal, and a drain of the tenth transistor is electrically connected to the second node.

In the GOA circuit provided in the present application, the reset module includes an eleventh transistor. A gate of the eleventh transistor and a source of the eleventh transistor are both input with the reset signal, and a drain of the eleventh transistor is electrically connected to the third node.

In the GOA circuit provided by the present application, the forward scan signal is inverted from the reverse scan signal.

In the GOA circuit provided by the present application, transistors in the GOA circuit are selected form any of low-temperature polysilicon thin-film transistors, oxide semiconductor thin-film transistors, or amorphous silicon thin-film transistors.

Correspondingly, the present application also provides a display panel, including a GOA circuit. The GOA circuit includes GOA units with multi-stage cascade, each stage of the GOA unit includes a pull-up control module, a bootstrap module, a pull-up module, a pull-down module, a pull-down maintenance module, and a reset module.

The pull-up control module is input with a N−2th stage scan signal and a forward scan signal, is electrically connected to a first node, and is configured to output the N−2th stage scan signal to the first node under control of the forward scan signal.

The bootstrap module is input with a N−1th stage clock signal, is electrically connected to the first node and the second node, and is configured to pull up a potential of the second node under control of a potential of the first node and the N−1th stage clock signal.

The pull-up module is input with a Nth stage clock signal, is electrically connected to the second node and the output terminal of a Nth stage scan signal, and is configured to output the Nth stage scan signal under control of the Nth stage clock signal and the potential of the second node.

The pull-down module is input with the forward scan signal, a reverse scan signal, a N+2th stage clock signal, a N−2th stage clock signal, a N+2th stage scan signal, a high-level signal, and a low-level signal, is electrically connected to the first node and a third node, and is configured to pull down the potential of the first node under control of the forward scan signal, the reverse scan signal, the N+2th stage clock signal, the N−2 stage clock signal, the N+2 stage scan signal, the high-level signal, and the low-level signal.

The pull-down maintenance module is input with the low-level signal, is electrically connected to the second node, the third node, and the output terminal of the Nth stage scan signal, and is configured to maintain low potentials of the second node and the Nth stage scan signal under control of a potential of the third node and the low-level signal.

The reset module is input with a reset signal, is electrically connected to the third node, and is configured to reset the potential of the second node and potential of the Nth stage scan signal under control of the reset signal.

In the display panel provided by the present application, the pull-up module includes a first transistor. A gate of the first transistor is input with the N−2th stage scan signal, a source of the first transistor is input with the forward scan signal, and a drain of the first transistor is electrically connected to the first node.

In the display panel provided by the present application, the bootstrap module includes a seventh transistor and a first capacitor, a gate of the seventh transistor, a source of the seventh transistor, and a first terminal of the first capacitor are all electrically connected to the first node, a drain of the seventh transistor is electrically connected to the second node, and a second terminal of the first capacitor is input with the N−1th stage clock signal.

In the display panel provided by the present application, the pull-up module includes a third transistor. A gate of the third transistor is electrically connected to the second node, a source of the third transistor is input with the Nth stage clock signal, and a drain of the third transistor is electrically connected to the output terminal of the Nth stage scan signal.

In the display panel provided by the present application, the pull-down module includes a second transistor, a fifth transistor, a sixth transistor, an eighth transistor, and a ninth transistor. A gate of the fifth transistor is input with the forward scan signal, and a source of the fifth transistor is input with the N+2th stage clock signal, a drain of the fifth transistor is electrically connected to a drain of the sixth transistor and a gate of the eighth transistor, a source of the sixth transistor is input with the N−2th stage clock signal, a gate of the sixth transistor and a source of the second transistor are both input with the reverse scan signal, a gate of the second transistor is input with the N+2 stage scan signal, a drain of the second transistor and a gate of the ninth transistor are both electrically connected to the first node, a source of the ninth transistor is input with the low-level signal, a drain of the ninth transistor and a drain of the eighth transistor are both electrically connected to the third node, and a source of the eighth transistor is input with the high-level signal.

In the display panel provided by the present application, the pull-down maintenance module includes a second capacitor, a fourth transistor, and a tenth transistor. A first terminal of the second capacitor, a gate of the fourth transistor, and a gate of the tenth transistor are all electrically connected to the third node, a second terminal of the second capacitor, a source of the fourth transistor, and a source of the tenth transistor are all input with the low-level signal, a drain of the fourth transistor is electrically connected to the output terminal of the Nth stage scan signal, and a drain of the tenth transistor is electrically connected to the second node.

In the display panel provided by the present application, the reset module includes an eleventh transistor; a gate of the eleventh transistor and a source of the eleventh transistor are both input with the reset signal, and a drain of the eleventh transistor is electrically connected to the third node.

In the display panel provided by the present application, the forward scan signal is inverted from the reverse scan signal.

In the display panel provided by the present application, transistors in the GOA circuit are selected form any of low-temperature polysilicon thin-film transistors, oxide semiconductor thin-film transistors, or amorphous silicon thin-film transistors.

In the display panel provided by the present application, transistors in the GOA circuit are all transistors of the same type.

Beneficial Effect

A gate driver on array (GOA) circuit and a display panel are provided, the GOA circuit includes GOA units with multi-stage cascade. Each GOA unit is provided with a bootstrap module. The bootstrap effect of the bootstrap module is utilized to increase the gate voltage of the output transistor, which can effectively reduce the rise time and fall time of the scan signal output by each stage of the GOA unit, thereby improving the charging capability of the display panel.

DESCRIPTION OF DRAWINGS

In order to more clearly describe the technical solutions in the embodiments of the present application, the following will briefly introduce the drawings that need to be used in the description of the embodiments. Obviously, the drawings in the description are only some embodiments of the present application. For those skilled in the art, other drawings can be obtained based on these drawings without paying creative effort.

DETAILED DESCRIPTION OF PREFERRED EMBODIMENTS

The technical solutions in the embodiments of the present application will be described clearly and completely with reference to the drawings in the embodiments of the present application. Obviously, the described embodiments are only a part of the embodiments of the present application, rather than all the embodiments. Based on these embodiments in the application, all other embodiments obtained by those skilled in the art without paying creative effort are within the protection scope of this application.

In the description of this application, it should be understood that the terms "first" and "second" are only used for description purposes, and cannot be understood as indicating or implying relative importance or implicitly indicating the number of indicated technical features. Therefore, the features defined as "first" and "second" may explicitly or implicitly include one or more of the features, and cannot be understood as a limitation of the application.

The transistors used in all the embodiments of this application can be thin film transistors or field-effect transistors or other elements with the same characteristics. Since the source and drain of the transistors used here are symmetrical, the source and drain are interchangeable. In the embodiments of the present application, in order to distinguish the two poles of the transistor other than gate, one of the poles is called the source and the other is called the drain. According to the morphological regulations in the figure, the middle end of the switching transistor is the gate, the signal input end is the source, and the output end is the drain. In addition, the transistors used in the embodiments of the present application may include P-type transistors and/or N-type transistors. The P-type transistor is turned on when the gate is at a low level and is turned off when the gate is at a high level. The N-type transistor is turned on when the gate is at a high level and is turned off when the gate is at a low level.

It should be noted that the transistors in the embodiments of the present application are all described by taking N-type transistors as an example, but it cannot be construed as a limitation of the present application.

Figure 1:
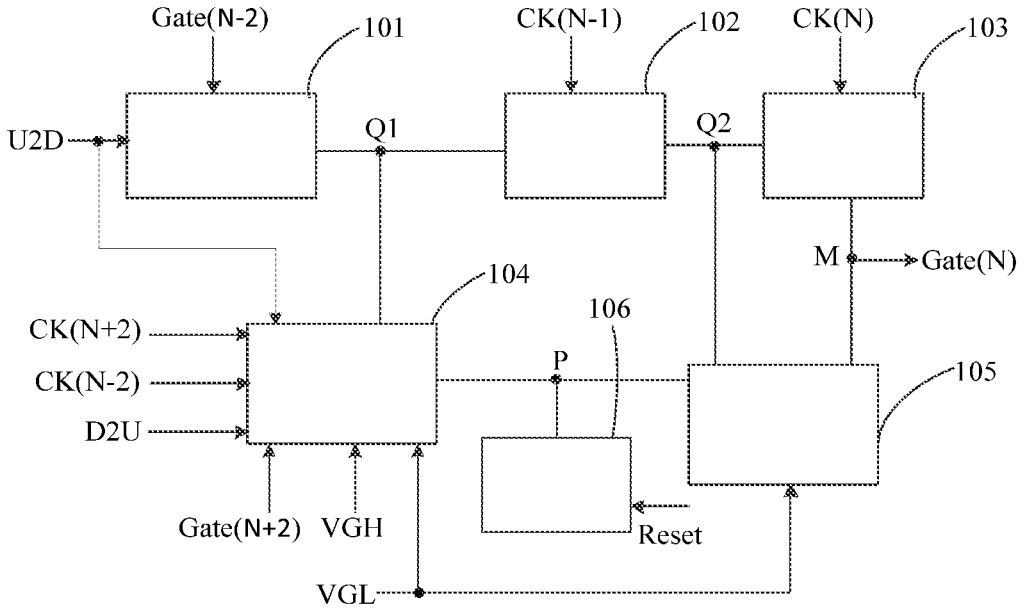
FIG. 1 is a schematic structural diagram of a gate driver on array (GOA) unit in a GOA circuit provided by an embodiment of this application.

Please refer to FIG. 1. FIG. 1 is a schematic diagram of a GOA unit in the GOA circuit provided by the present application. As shown in FIG. 1, the GOA circuit includes multi-stage cascaded GOA units, and each GOA unit includes a pull-up control module 101, a bootstrap module 102, a pull-up module 103, a pull-down module 104, a pull-down maintenance module 105, and a reset module 106.

The pull-up control module 101 is input with a N−2th stage scan signal Gate (N−2) and a forward scan signal U2D, is electrically connected to a first node Q1, and is configured to output the N−2th stage scan signal Gate (N−2) to the first node Q1 under control of the forward scan signal U2D.

The bootstrap module 102 is input with a N−1th stage clock signal CK (N−1), is electrically connected to the first node Q1 and the second node Q2, and is configured to pull up a potential of the second node Q2 under control of a potential of the first node Q1 and the N−1th stage clock signal CK (N−1).

The pull-up module 103 is input with a Nth stage clock signal CK (N), is electrically connected to the second node Q2 and an output terminal M of a Nth stage scan signal, and is configured to output the Nth stage scan signal Gate (N) under control of the Nth stage clock signal CK (N) and the potential of the second node Q2.

The pull-down module 104 is input with the forward scan signal U2D, a reverse scan signal D2U, a N+2th stage clock signal CK (N+2), a N−2th stage clock signal CK (N−2), a N+2 stage scan signal Gate (N+2), a high-level signal VGH, and a low-level signal VGL, is electrically connected to the first node Q1 and a third node P, and is configured to pull down the potential of the first node Q1 under control of the forward scan signal U2D, the reverse scan signal D2U, the N+2th stage clock signal CK (N+2), the N−2 stage clock signal CK (N−2), the N+2 stage scan signal Gate (N+2), the high-level signal VGH, and the low-level signal VGL.

The pull-down maintenance module 105 is input with the low-level signal VGL, is electrically connected to the second node Q2, the third node P, and the output terminal M of the Nth stage scan signal, and is configured to maintain low potentials of the second node Q2 and the Nth stage scan signal Gate (N) under control of a potential of the third node P and the low-level signal VGL.

The reset module 106 is input with a reset signal Reset, is electrically connected to the third node P, and is configured to reset the potential of the second node Q2 and a potential of the Nth stage scan signal Gate (N) under control of the reset signal Reset.

The GOA circuit provided by the embodiment of the present application includes multi-stage cascaded GOA units, and each GOA unit includes a bootstrap module 102. A bootstrap effect of the bootstrap module 102 is utilized to increase the potential of the second node Q2, thereby reducing the rise time and fall time of the scan signal output by the GOA unit, and improving the charging capability of the display panel.

Figure 2:
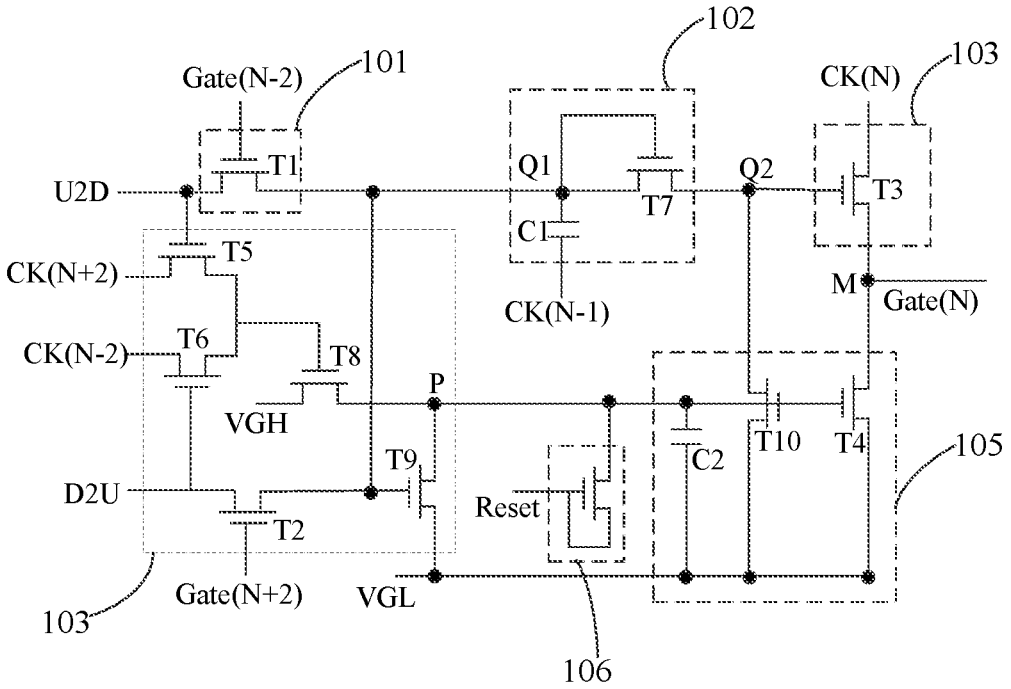
FIG. 2 is a schematic circuit diagram of a GOA unit in the GOA circuit provided by an embodiment of this application.

Further, please refer to FIG. 2, which is a schematic circuit diagram of a GOA unit in the GOA circuit provided by the present application. As shown in FIG. 2, the pull-up module 101 includes a first transistor T1. The gate of the first transistor T1 is input with the N−2th stage scan signal Gate (N−2). The source of the first transistor T1 is input with the forward scan signal U2D. The drain of the first transistor T1 is electrically connected to the first node Q1.

The bootstrap module 102 includes a seventh transistor T7 and a first capacitor C1. A gate of the seventh transistor T7, a source of the seventh transistor T7, and a first terminal of the first capacitor C1 are all electrically connected to the first node Q1. A drain of the seventh transistor T7 is electrically connected to the second node Q2. A second terminal of the first capacitor C1 is connected to the N−1th stage clock signal CK (N−1).

The pull-up module 103 includes a third transistor T3, a gate of the third transistor T3 is electrically connected to the second node Q2. A source of the third transistor T3 is input with the Nth stage clock signal CK (N). A drain of the third transistor T3 is electrically connected to the output terminal Gate (N) of the Nth stage scan signal.

The pull-down module 104 includes a second transistor T2, a fifth transistor T5, a sixth transistor T6, an eighth transistor T8, and a ninth transistor T9.

A gate of the fifth transistor T5 is input with the forward scan signal U2D. A source of the fifth transistor T5 is input with the N+2th stage clock signal CK (N+2). A drain of the fifth transistor T5 is electrically connected to a drain of the sixth transistor T6 and a gate of the eighth transistor T8. A source of the sixth transistor T6 is input with the N−2th stage clock signal CK (N−2). A gate of the sixth transistor T6 and a source of the second transistor T2 are both input with the reverse scan signal D2U. A gate of the second transistor T2 is input with the N+2 stage scan signal Gate (N+2). A drain of the second transistor T2 and a gate of the ninth transistor T9 are both electrically connected to the first node Q1. A source of the ninth transistor T9 is input with the low-level signal VGL. A drain of the ninth transistor T9 and a drain of the eighth transistor T8 are both electrically connected to the third node P. A source of the eighth transistor T8 is input with the high-level signal VGH.

The pull-down maintenance module 105 includes a second capacitor C2, a fourth transistor T4, and a tenth transistor T10. A first terminal of the second capacitor C2, a gate of the fourth transistor T4, and a gate of the tenth transistor T10 are all electrically connected to the third node P. A second terminal of the second capacitor C2, a source of the fourth transistor T4, and a source of the tenth transistor T10 are all input with the low-level signal VGL. A drain of the fourth transistor T4 is electrically connected to the output terminal Gate (N) of the Nth stage scan signal. A drain of the tenth transistor T10 is electrically connected to the second node Q2.

The reset module 106 includes an eleventh transistor T11.

A gate of the eleventh transistor T11 and a source of the eleventh transistor T11 are both input with the reset signal Reset, and a drain of the eleventh transistor T11 is electrically connected to the third node P.

It should be noted that, in the embodiment of the present application, the forward scan signal U2D is inverted from the reverse scan signal D2U. When the GOA circuit is in the turn-on function stage, a path between the forward scan signal U2D or the reverse scan signal D2U and the first node Q1 can be isolated by the N−2th stage scan signal G (N−2) and the N+2th stage scan signal G (N+2). A high-level forward scan signal U2D or a reverse scan signal D2U is utilized for driving to avoid the competing path in the GOA circuit. In each embodiment of the present application, the forward scan signal U2D is at a high level and the reverse scan signal D2U is at a low level as an example for description, but it cannot be construed as a limitation of the present application.

The GOA circuit provided by the embodiment of the present application includes multi-stage cascaded GOA units, and each GOA unit adopts an 11T2C architecture and has a simple structure. Each GOA unit includes a bootstrap module 102, the bootstrap module 102 includes a first capacitor C1 and a seventh transistor T7. Each GOA unit utilizes the bootstrap effect of the bootstrap module 102 during operation to increase the gate voltage of the third transistor T3, so that the third transistor T3 fully turned on, thereby reducing the rise time and fall time of the scan signal it outputs, and improving the charging capacity of the display panel.

Figure 3:
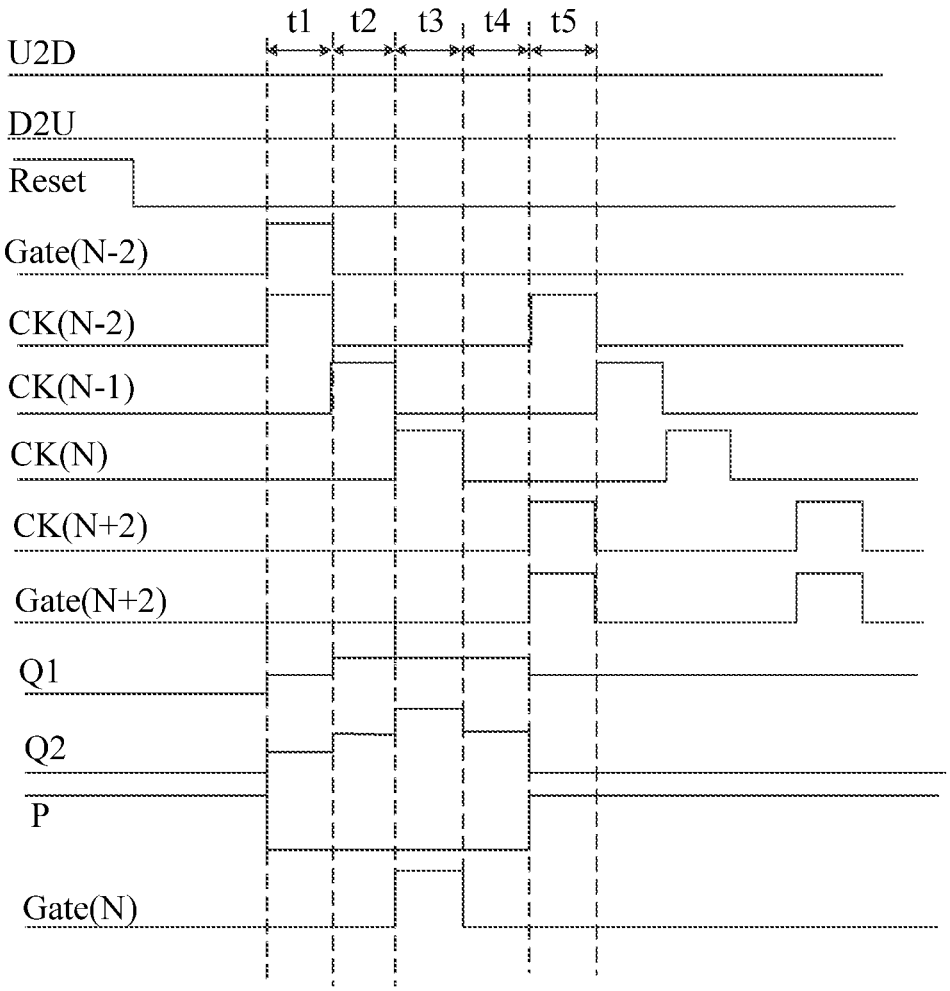
FIG. 3 is a signal timing diagram of the GOA unit in the GOA circuit provided by an embodiment of the application.

Please refer to FIG. 3, which is a signal timing diagram of a GOA unit in the GOA circuit provided by the present application. As shown in FIG. 3, in an embodiment of the present application, the working sequence of the GOA unit in FIG. 2 includes the following stages.

The stage before t1: Before the start of a frame, the reset signal Reset will be set high. The eleventh transistor T11 is turned on, and the potential of the third node P is pulled up to a high level so that the tenth transistor T10 and the fourth transistor T4 are turned on. Following, the potential of the second node Q2 is pulled down to a low level, and the initial potential of the Nth stage scan signal Gate(N) is the same as the potential of the low-level signal VGL. After that, the reset signal Reset changes from a high level to a low level, so that the eleventh transistor T11 is turned off, and the GOA unit stands by until stage t1 starts.

Stage t1: Both the N−2th stage scan signal Gate (N−2) and the N−2th stage clock signal CK (N−2) rise to a high level. The first transistor T1 is turned on, the potential of the first node Q1 is pulled up to VGH, the first capacitor C1 is charged, the seventh transistor T7 is turned on, the potential of the second node Q2 is also pulled up to VGH, and the third transistor T3 is turned on. At this time, since the Nth stage clock signal CK (N) is a low-level signal, the Nth stage scan signal Gate (N) outputs a low potential. At the same time, since the potential of the first node Q1 is pulled up to VGH, the ninth transistor T9 is turned on, the potential of the third node P is pulled down to a low potential, and the fourth transistor T4 and the tenth transistor T10 are turned off.

It should be noted that at this stage, the N−2th stage clock signal rises to a high level. However, since the reverse scan signal D2U is inverted from the forward scan signal and remains as a low-level signal, the sixth transistor T6 is turned off.

Stage t2: The N−2th stage scan signal Gate (N−2) is converted from a high level to a low level, the first transistor T1 is turned off, and the first node Q1 is in a suspended state. The N−1th stage clock signal CK (N−1) rises to a high level. At this time, the potential of the first node Q1 becomes 2VGH due to the bootstrap effect. The seventh transistor T7 is kept turned-on so that the potential of the second node Q2 is charged to 2VGH. Since there is no leakage path, the potential of the first node Q1 and the potential of the second node Q2 both maintain a high level. The existence of the capacitor C1 makes the potential of the first node Q1 and the potential of the second node Q2 more stable.

Stage t3: The N−1th stage clock signal CK (N−1) becomes low level, the seventh transistor T7 is equivalent to a reverse diode, and the potential of the second node Q2 is maintained at 2VGH. At the same time, since the Nth stage clock signal CK (N) becomes high level, the second node Q2 is affected by the bootstrap effect of the third transistor T3, and its potential will be pulled up to 3VGH so that the third transistor T3 is fully turned on, and the Nth stage scan signal Gate (N) can be output in full swing.

It should be noted that at this stage, the potential of the second node Q2 is pulled up to 3VGH due to the bootstrap effect so that the gate voltage of the third transistor T3 is quickly pulled up to a fully turned-on state. This effectively reduces the rise time of the Nth-stage scan signal Gate (N), thereby effectively charging the scan line corresponding to the Nth-stage GOA unit and improving the charging capability of the display panel.

Stage t4: The Nth stage clock signal CK (N) changes from high level to low level, the potential of the second node Q2 becomes 2VGH, and the third transistor T3 is still fully turned on. At this time, the Nth stage scan signal Gate (N) is quickly pulled down to VGL.

It should be noted that at this stage, due to the existence of the bootstrap module 102, the potential of the second node Q2 is maintained at 2VGH, so that the third transistor T3 is fully turned on. Since the Nth stage clock signal CK (N) is already low level at this time, the Nth stage scan signal Gate (N) can be pulled down to low level instantly, which effectively reduces the fall time of the Nth stage scan signal Gate (N). In addition, the scan line corresponding to the Nth stage GOA unit is effectively charged, the problem of signal interference caused by the short charging time of the pixel area, the data signal has changed, and the scan signal is not turned off is avoided.

Stage t5: The N+2th stage clock signal CK (N+2) and the N+2th stage scan signal Gate (N+2) rise to a high level, and the fifth transistor T5, the eighth transistor T8, and the second transistor T2 are turned on. The potential of the first node Q1 is pulled down, the potential of the third node P is pulled up, and the tenth transistor T10 is turned on. The potential of the second node Q2 is pulled down, and the third transistor T3 is turned off. The fourth transistor T4 is turned on, and the Nth stage scan signal Gate (N) is pulled down to VGL. In this process, the second capacitor C2 is charged to maintain the high potential of the third node P, so that the tenth transistor T10 and the fourth transistor T4 are in a stable turned-on state. Therefore, the low potential of the second node Q2 and the Nth stage scan signal Gate (N) is maintained.

The transistors of the GOA circuit provided in this application are all low-temperature polysilicon thin-film transistors, oxide semiconductor thin-film transistors, or amorphous silicon thin-film transistors. In addition, the transistors of the GOA circuit provided by the embodiments of the present application are the same type of transistors, so as to avoid the influence of the difference between different types of transistors on the pixel driving circuit and simplify the process.

Figure 4:
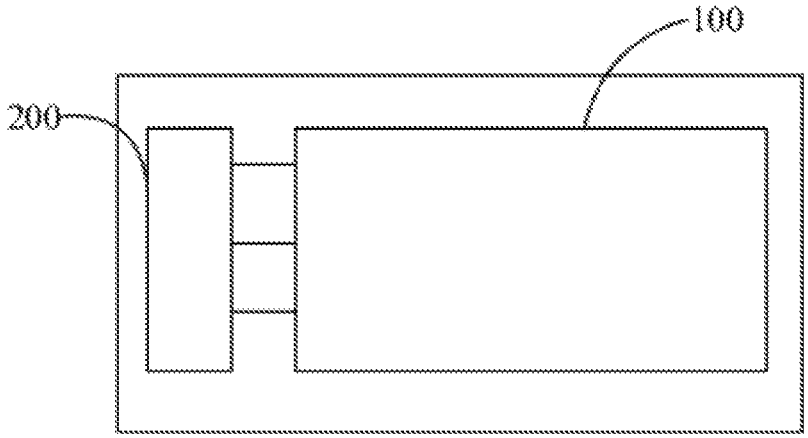
FIG. 4 is a schematic structural diagram of a display panel provided by an embodiment of the application.

Please refer to FIG. 4, which is a schematic diagram of a structure of the display panel provided by this application. As shown in FIG. 4, the display panel includes a display area 100 and a GOA circuit 200 integrally arranged on an edge of the display area 100; wherein, the structure and principle of the GOA circuit 200 are similar to the above-mentioned GOA circuit, and will not be repeated here. The display panel includes but is not limited to a liquid crystal display panel, an organic light-emitting diode (OLED) display panel, a light-emitting diode (LED) display panel, and a quantum dot light-emitting diode (QLED) display panel.

It should be noted that the display panel provided by the embodiment of the present application is introduced by taking the single-side driving manner in which the GOA circuit 200 is provided on a side of the display area 100 as an example, but it cannot be understood as a limitation of the present application. In some embodiments, other driving manners such as double-side driving cab be adopted bases on actual requirements of the display panel, which is not specifically limited in this application.

The display panel provided by the present application is provided with a GOA circuit. The GOA circuit includes multi-stage cascaded GOA units, and each GOA unit includes a bootstrap module. A bootstrap effect of the bootstrap module is utilized to increase the gate voltage of the output transistor, which can effectively reduce the rise time and fall time of the scan signal output by each GOA unit, thereby improving the charging capability of the display panel.

The GOA circuit and the display device provided by the present application are described in detail above. The principles and implementation manners of the present application are described in specific embodiments. The descriptions of the embodiments are only used to help understand the methods and core ideas of the present application. For those of ordinary skill in the art, according to the ideas of this application, there will be modifications in the embodiments and the scope of application. As described above, the content of this specification should not be construed as a limitation on this application.

What is claimed is:

1. A gate driver on array (GOA) circuit, comprising GOA units with multi-stage cascade, each stage of the GOA unit comprising a pull-up control module, a bootstrap module, a pull-up module, a pull-down module, a pull-down maintenance module, and a reset module; wherein the pull-up control module is input with a N−2th stage scan signal and a forward scan signal, is electrically connected to a first node, and is configured to output the N−2th stage scan signal to the first node under control of the forward scan signal;

the bootstrap module is input with a N−1th stage clock signal, is electrically connected to the first node and the second node, and is configured to pull up a potential of the second node under control of a potential of the first node and the N−1th stage clock signal;

the pull-up module is input with a Nth stage clock signal, is electrically connected to the second node and an output terminal of a Nth stage scan signal, and is configured to output the Nth stage scan signal under control of the Nth stage clock signal and the potential of the second node;

the pull-down module is input with the forward scan signal, a reverse scan signal, a N+2th stage clock signal, a N−2th stage clock signal, a N+2 stage scan signal, a high-level signal, and a low-level signal, is electrically connected to the first node and a third node, and is configured to pull down the potential of the first node under control of the forward scan signal, the reverse scan signal, the N+2th stage clock signal, the N−2 stage clock signal, the N+2 stage scan signal, the high-level signal, and the low-level signal;

the pull-down maintenance module is input with the low-level signal, is electrically connected to the second node, the third node, and the output terminal of the Nth stage scan signal, and is configured to maintain low potentials of the second node and the Nth stage scan signal under control of a potential of the third node and the low-level signal; and the reset module is input with a reset signal, is electrically connected to the third node, and is configured to reset the potential of the second node and a potential of the Nth stage scan signal under control of the reset signal.

2. The GOA circuit according to claim 1, wherein the pull-up module comprises a first transistor; a gate of the first transistor is input with the N−2th stage scan signal, a source of the first transistor is input with the forward scan signal, and a drain of the first transistor is electrically connected to the first node.

3. The GOA circuit according to claim 1, wherein the bootstrap module comprises a seventh transistor and a first capacitor, a gate of the seventh transistor, a source of the seventh transistor, and a first terminal of the first capacitor are all electrically connected to the first node, a drain of the seventh transistor is electrically connected to the second node, and a second terminal of the first capacitor is input with the N−1th stage clock signal.

4. The GOA circuit according to claim 1, wherein the pull-up module comprises a third transistor, a gate of the third transistor is electrically connected to the second node, a source of the third transistor is input with the Nth stage clock signal, and a drain of the third transistor is electrically connected to the output terminal of the Nth stage scan signal.

5. The GOA circuit according to claim 1, wherein the pull-down module comprises a second transistor, a fifth transistor, a sixth transistor, an eighth transistor, and a ninth transistor; a gate of the fifth transistor is input with the forward scan signal, and a source of the fifth transistor is input with the N+2th stage clock signal, a drain of the fifth transistor is electrically connected to a drain of the sixth transistor and a gate of the eighth transistor, a source of the sixth transistor is input with the N−2th stage clock signal, a gate of the sixth transistor and a source of the second transistor are both input with the reverse scan signal, a gate of the second transistor is input with the N+2 stage scan signal, a drain of the second transistor and a gate of the ninth transistor are both electrically connected to the first node, a source of the ninth transistor is input with the low-level signal, a drain of the ninth transistor and a drain of the eighth transistor are both electrically connected to the third node, and a source of the eighth transistor is input with the high-level signal.

6. The GOA circuit according to claim 1, wherein the pull-down maintenance module comprises a second capacitor, a fourth transistor, and a tenth transistor; a first terminal of the second capacitor, a gate of the fourth transistor, and a gate of the tenth transistor are all electrically connected to the third node, a second terminal of the second capacitor, a source of the fourth transistor, and a source of the tenth transistor are all input with the low-level signal, a drain of the fourth transistor is electrically connected to the output terminal of the Nth stage scan signal, and a drain of the tenth transistor is electrically connected to the second node.

7. The GOA circuit according to claim 1, wherein the reset module comprises an eleventh transistor; a gate of the eleventh transistor and a source of the eleventh transistor are both input with the reset signal, and a drain of the eleventh transistor is electrically connected to the third node.

8. The GOA circuit according to claim 1, wherein the forward scan signal is inverted from the reverse scan signal.

9. The GOA circuit according to claim 1, wherein transistors in the GOA circuit are selected form any of low-temperature polysilicon thin-film transistors, oxide semiconductor thin-film transistors, or amorphous silicon thin-film transistors.

10. The GOA circuit according to claim 1, wherein transistors in the GOA circuit are all transistors of a same type.

11. A display panel, comprising a GOA circuit, the GOA circuit comprising GOA units with multi-stage cascade, each stage of the GOA unit comprising a pull-up control module, a bootstrap module, a pull-up module, a pull-down module, a pull-down maintenance module, and a reset module; wherein the pull-up control module is input with a N−2th stage scan signal and a forward scan signal, is electrically connected to a first node, and is configured to output the N−2th stage scan signal to the first node under control of the forward scan signal;

the bootstrap module is input with a N−1th stage clock signal, is electrically connected to the first node and the second node, and is configured to pull up a potential of the second node under control of a potential of the first node and the N−1th stage clock signal;

the pull-up module is input with a Nth stage clock signal, is electrically connected to the second node and an output terminal of a Nth stage scan signal, and is configured to output the Nth stage scan signal under control of the Nth stage clock signal and the potential of the second node;

the pull-down module is input with the forward scan signal, a reverse scan signal, a N+2th stage clock signal, a N−2th stage clock signal, a N+2th stage scan signal, a high-level signal, and a low-level signal, is electrically connected to the first node and a third node, and is configured to pull down the potential of the first node under control of the forward scan signal, the reverse scan signal, the N+2th stage clock signal, the N−2 stage clock signal, the N+2 stage scan signal, the high-level signal, and the low-level signal;

the pull-down maintenance module is input with the low-level signal, is electrically connected to the second node, the third node, and the output terminal of the Nth stage scan signal, and is configured to maintain low potentials of the second node and the Nth stage scan signal under control of a potential of the third node and the low-level signal; and the reset module is input with a reset signal, is electrically connected to the third node, and is configured to reset the potential of the second node and a potential of the Nth stage scan signal under control of the reset signal.

12. The display panel according to claim 11, wherein the pull-up module comprises a first transistor; a gate of the first transistor is input with the N−2th stage scan signal, a source of the first transistor is input with the forward scan signal, and a drain of the first transistor is electrically connected to the first node.

13. The display panel according to claim 11, wherein the bootstrap module comprises a seventh transistor and a first capacitor, a gate of the seventh transistor, a source of the seventh transistor, and a first terminal of the first capacitor are all electrically connected to the first node, a drain of the seventh transistor is electrically connected to the second node, and a second terminal of the first capacitor is input with the N−1th stage clock signal.

14. The display panel according to claim 11, wherein the pull-up module comprises a third transistor, a gate of the third transistor is electrically connected to the second node, a source of the third transistor is input with the Nth stage clock signal, and a drain of the third transistor is electrically connected to the output terminal of the Nth stage scan signal.

15. The display panel according to claim 11, wherein the pull-down module comprises a second transistor, a fifth transistor, a sixth transistor, an eighth transistor, and a ninth transistor; a gate of the fifth transistor is input with the forward scan signal, and a source of the fifth transistor is input with the N+2th stage clock signal, a drain of the fifth transistor is electrically connected to a drain of the sixth transistor and a gate of the eighth transistor, a source of the sixth transistor is input with the N−2th stage clock signal, a gate of the sixth transistor and a source of the second transistor are both input with the reverse scan signal, a gate of the second transistor is input with the N+2 stage scan signal, a drain of the second transistor and a gate of the ninth transistor are both electrically connected to the first node, a source of the ninth transistor is input with the low-level signal, a drain of the ninth transistor and a drain of the eighth transistor are both electrically connected to the third node, and a source of the eighth transistor is input with the high-level signal.

16. The display panel according to claim 11, wherein the pull-down maintenance module comprises a second capacitor, a fourth transistor, and a tenth transistor; a first terminal of the second capacitor, a gate of the fourth transistor, and a gate of the tenth transistor are all electrically connected to the third node, a second terminal of the second capacitor, a source of the fourth transistor, and a source of the tenth transistor are all input with the low-level signal, a drain of the fourth transistor is electrically connected to the output terminal of the Nth stage scan signal, and a drain of the tenth transistor is electrically connected to the second node.

17. The display panel according to claim 11, wherein the reset module comprises an eleventh transistor; a gate of the eleventh transistor and a source of the eleventh transistor are both input with the reset signal, and a drain of the eleventh transistor is electrically connected to the third node.

18. The display panel according to claim 11, wherein the forward scan signal is inverted from the reverse scan signal.

19. The display panel according to claim 11, wherein transistors in the GOA circuit are selected form any of low-temperature polysilicon thin-film transistors, oxide semiconductor thin-film transistors, or amorphous silicon thin-film transistors.

20. The display panel according to claim 11, wherein transistors in the GOA circuit are all transistors of a same type.

* * * * *